US005425063A

United States Patent [19]

Ferrieri et al.

[11] Patent Number: 5,425,063

[45] Date of Patent: Jun. 13, 1995

[54] METHOD FOR SELECTIVE RECOVERY OF PET-USABLE QUANTITIES OF [$^{18}$F] FLUORIDE AND [$^{13}$N] NITRATE/NITRITE FROM A SINGLE IRRADIATION OF LOW-ENRICHED [$^{18}$O] WATER

[75] Inventors: Richard A. Ferrieri, Patchogue; David J. Schlyer, Bellport; Colleen Shea, Wading River, all of N.Y.

[73] Assignee: Associated Universities, Inc., Washington, D.C.

[21] Appl. No.: 42,741

[22] Filed: Apr. 5, 1993

[51] Int. Cl.$^6$ ..... G21G 1/10

[52] U.S. Cl. ..... 376/195; 376/190

[58] Field of Search ..... 376/190, 194, 195, 196, 376/198, 199, 201

[56] References Cited

U.S. PATENT DOCUMENTS 5,280,505 1/1994 Hughey et al. ..... 376/194

OTHER PUBLICATIONS

Appl. Radiat. Isot. vol. 38, No. 11, pp. 979–984, (1987), Iwata et al.

Int. J. Appl. Radiat. Isot. vol. 33, (1982), pp. 633–636, Irie et al.

Int. J. Appl. Radiat. Isot. vol. 24, (1976), pp. 124–126, Lindner et al (I).

Int. J. Appl. Radiat. Isot., vol. 29 (1978), pp. 754–757, Parks et al.

Appl. Radiat. Isot. vol. 37, No. 8, pp. 649–657, 659–661, (1986), Nickles et al.

Int. J. Appl. Radiat. Isot. vol. 30, pp. 50614–507, (1979) Lindner et al (II).

Int. J. Appl. Radiat. & Isot. vol. 26, No. 5, (May 1975), pp. 316–318, Vaalburg et al.

Int. J. Appl. Radiat. & Isot. vol. 26, (1975), pp. 763–770, Servian.

Appl. Radiat. Isot. vol. 41, No. 1, pp. 49–55, (1990) Hamacher et al.

Appl. Radiat. Isot. vol. 38, No. 8, pp. 605–610 (1987) Coenen et al.

*Primary Examiner*—Behrend E. Harvey

*Attorney, Agent, or Firm*—Margaret C. Bogosian

[57] ABSTRACT

A process for simultaneously producing PET-usable quantities of [$^{13}$N]$NH_3$ and [$^{18}$F]F− for radiotracer synthesis is disclosed. The process includes producing [$^{13}$N]$NO_2$−/$NO_3$− and [$^{18}$F]F− simultaneously by exposing a low-enriched (20%–30%) [$^{18}$O]$H_2O$ target to proton irradiation, sequentially isolating the [$^{13}$N]$NO_2$−/$NO_3$− and [$^{18}$F]F− from the [$^{18}$O]$H_2O$ target, and reducing the [$^{13}$N]$NO_2$−/$NO_3$− to [$^{13}$N]$NH_3$. The [$^{13}$N]$NH_3$ and [$^{18}$F]F− products are then conveyed to a laboratory for radiotracer applications. The process employs an anion exchange resin for isolation of the isotopes from the [$^{18}$O]$H_2O$, and sequential elution of [$^{13}$N]$NO_2$−/$NO_3$− and [$^{18}$F]F− fractions. Also the apparatus is disclosed for simultaneously producing PET-usable quantities of [$^{13}$N]$NH_3$ and [$^{18}$F]F− from a single irradiation of a single low-enriched [$^{18}$O]$H_2O$ target.

11 Claims, 2 Drawing Sheets

METHOD FOR SELECTIVE RECOVERY OF PET-USABLE QUANTITIES OF [$^{18}$F] FLUORIDE AND [$^{13}$N] NITRATE/NITRITE FROM A SINGLE IRRADIATION OF LOW-ENRICHED [$^{18}$O] WATER

This invention was made with Government support under Contract Number DE AC02-76CH00016 between the U.S. Department of Energy and Associated Universities, Inc. The Government has certain rights in the invention.

BACKGROUND OF THE INVENTION

1. Field of the Invention

The present invention relates generally to methods for quantitative production and selective recovery of usable quantities of [$^{18}$F]F$^-$ and [$^{13}$N]$NO_3^-$/$NO_2^-$ from irradiation of low-enriched [$^{18}$O]$H_2O$, for radiotracer synthesis for clinical PET imaging.

2. Description of the Related Art

The clinical usefulness of positron emission tomography (PET) studies using [$^{13}$N]ammonia ([$^{13}$N]$NH_3$) and 1-[$^{18}$F]fluoro-2-deoxy-D-glucose ([$^{18}$F]FDG) is well established. Myocardial imaging in clinical PET using [$^{13}$N]$NH_3$ to measure blood flow followed in series with [$^{18}$F]FDG to assess tissue glucose uptake, is finding increased use for diagnosing myocardial disease. Schelbert, H. R. and Schwaiger, M., in Phelps, M. E., Mazziotta, J. C. and Schelbert, H. R. (eds.), (1986) *Positron Emission Tomography and Autoradiography*, Raven Press, New York. Chapter 12. These agents are among the best validated and most widely used PET tracers in humans and will serve as key agents in clinical PET programs for the foreseeable future. As the demand for PET studies increases, cyclotron-PET facilities must find ways to economically provide large quantities of these tracers for clinical use.

Logistical complications arise in protocols requiring more than one agent simultaneously, such as when [$^{13}$N]$NH_3$ and [$^{18}$F]FDG are required in combination for heart studies. Matters are further complicated by the relatively short half-lives of the $^{13}$N and $^{18}$F isotopes, 10 minutes and 110 minutes, respectively. Studies of this nature can impose enormous time constraints on both cyclotron and hot lab operations to produce and deliver these radiotracers in rapid succession. Such constraints can lead to unnecessary radiation exposure to personnel, particularly if production targets are mounted by hand, to excessive cyclotron usage, and ultimately to longer radiotracer delivery times. Under these circumstances, it is important for isotope production schedules to be flexible and agent syntheses to be simple, reliable and fast.

Mulholland et al. in "Direct Simultaneous Production of [$^{15}$O]Water and [$^{13}$N]Ammonia or [$^{18}$F]Fluoride Ion by 26 MeV Proton Irradiation of a Double Chamber Water Target", *Appl. Radiat. Isot.*, 41(12), 1195–1199 (1990) describe a double liquid chamber target to provide simultaneous production of [$^{15}$O]$H_2O$ and either $^{13}$N or $^{18}$F using a single proton beam. Proton irradiation of natural water in a first chamber produces [$^{15}$O]$H_2O$ by the $^{16}$O(p,pn)$^{15}$O reaction. The [$^{15}$O]$H_2O$ is separated from the natural water using a mixed bed of 3:1:1 AG1:AG50:Chelex 100 ion exchange resins (reusable) for in-line purification of the water as it leaves the target.

A second target chamber, also in line with the incident proton beam, is used for the production of either $^{13}$N or $^{18}$F. If $^{13}$N is to be produced, the second chamber contains natural water and the $^{16}$O(p,$\alpha$)$^{13}$N reaction is employed. Alternatively, if $^{18}$F is desired, the second chamber contains [$^{18}$O]$H_2O$ and the $^{18}$O(p,n)$^{18}$F reaction is employed. Hydrogen gas is used in both the front and rear chambers to suppress boiling and maintain proper target thickness while creating a reducing atmosphere to inhibit oxidation of the target precursors. An in-line anion exchange (AG1) (Cl$^-$) resin-containing column is used for radiochemical cleanup to produce high yields of sterile, aqueous [$^{13}$N]$NH_3$ (40–200 mCi; 20 $\mu$A) directly in-line from the rear chamber at the same time that the [$^{15}$O]$H_2O$ is produced in the front chamber. Mulholland et al. report that an AG1 column is effective in removing [$^{13}$N]$NO_3^-$/$NO_2^-$ contaminants from the [$^{13}$N]$NH_3$, as well as trace amounts of [$^{18}$F]F$^-$, produced incidentally due to the $^{18}$O present in natural abundance in the target water (see, Mulholland et al., *J. Nucl. Med.*, 30, 926 (1989)).

Although Mulholland et al. describe the simultaneous production of [$^{15}$O]$H_2O$ with either [$^{13}$N]$NH_3$ or [$^{18}$F]F$^-$, they do not disclose or suggest the simultaneous production and purification of [$^{13}$N]$NH_3$ and [$^{18}$F]F$^-$ from low-enriched [$^{18}$O]$H_2O$. Mulholland et al. use natural [$^{16}$O]$H_2O$ in the rear target for producing [$^{13}$N]$NH_3$ directly, and dispose of any trace amounts of $^{13}$N or $^{18}$F anions that might be produced. Alternatively, Mulholland et al. use expensive, highly enriched [$^{18}$O]$H_2O$ to produce [$^{18}$F]F$^-$ ions. Accordingly, the apparatus and methods described by Mulholland et al. are incapable of producing usable quantities of both $^{13}$N and $^{18}$F radioisotopes from a single irradiation.

Other target and ion separation systems for recovering one of the two isotopes of interest are described in various publications. For example, Mulholland et al., "A Reliable Pressurized Water Target for F-18 Production at High Beam Currents", *J. Lab. Cpds. Radiopharm.*, 26, 192 (1989) is solely directed to the production of $^{18}$F from enriched [$^{18}$O]$H_2O$-containing targets; while Mulholland et al., "Direct In-Target Synthesis of Aqueous N-13 Ammonia by Proton Irradiation of Water Under Hydrogen Pressure", *J. Nucl. Med.*, 30, 926 (1989) is solely directed to the production of $^{13}$N[$NH_3$] from natural [$^{16}$O]$H_2O$ containing targets. Likewise, U.S. Pat. No. 4,752,432 discloses a device and process for production [$^{13}$N]$NH_4^+$ ion from a $^{13}$C/fluid slurry target. This patent describes the use of a conventional purification column to remove unwanted nitrogen oxides ($NO_x^-$), yielding the purified [$^{13}$N]$NH_4^+$ ion aqueous product. The Schlyer et al. article, "Separation of [$^{18}$F]Fluoride from [$^{18}$O]Water Using Anion Exchange Resin", *Appl. Radiat. Isot.*, 41(6), 531–533 (1990) describes the use of a $^{18}$O enriched water target which is bombarded with a proton beam. The method uses an anion exchange resin, Dowex 1X-10, 200–400 mesh in the chloride form which is converted to the hydroxide form. Schlyer et al. also describe using the carbonate form of the resin after similar procedures, rinsing the column with either 0.1M $K_2CO_3$ or 0.1M $Cs_2CO_3$ solution to elute the $^{18}$F from the column. There is no description in this paper for recovering [$^{13}$N]$NO_x^-$ anions.

Another procedure for recovery of [$^{18}$F]F$^-$ from [$^{18}$O]$H_2O$ after proton bombardment of a target is described by Alexoff et al., in "Recovery of [$^{18}$F]Fluoride from [$^{18}$O]Water in an Electrochemical Cell", *Appl. Radiat. Isot.*, 40(1), 1–6 (1989). This method only recovers $[^{18}F]F^-$ from the $[^{18}O]H_2O$ and does not describe or suggest the production or recovery of $^{13}N$.

The separation of various radioactive isotopes using anion exchange resins is well known. A detailed recitation of such separations is provided by Lavrukhina et al., in "*CHEMICAL ANALYSIS OF RADIOACTIVE MATERIALS*", Chapter 2 "Theoretical Bases of the Methods of Radiochemical Analysis", 67–175, Iliffe Books, Ltd. London (1967). Specifically, pages 122–126 contain a discussion of the separation of elements using anion exchange chromatography. The discussion is focused towards the use of anion exchange resin such as Dowex-1-X-8 resin to separate various heavy metals and other fission products. Lavrukhina et al. do not describe or suggest the separation of $^{18}F^-$, $^{13}N^-$ anions from low-enriched $[^{18}O]H_2O$. Similarly, U.S. Pat. No. 2,636,044 describes rare earth separations by anion exchange chromatography. The only examples in the patent are for the extraction of radioactive Pm and Eu with a citric acid eluant. In addition, U.S. Pat. No. 3,953,568 describes a method for simultaneously separating radioisotopes of a single element from each other using an anion exchange resin column and a ligand which preferably binds to one of the isotopes. There is no description of separation of different radioisotopes, such as $^{18}F$ and $^{13}N$ anions from low-enriched $[^{18}O]H_2O$.

Although other methods and processes are known for the clinical and experimental production of isotopes by proton irradiation, none provides a method for simultaneously producing usable quantities of $[^{13}N]NH_3$ and $[^{18}F]F^-$ and the selective isolation and recovery of the isotopes for radiotracer synthesis.

Accordingly, it is a purpose of the invention to provide an improved method for the simultaneous production of $^{13}N$ and $^{18}F$ isotopes for radiotracer synthesis.

It is also a goal of the invention to provide an improved process for selective extraction and recovery of $^{13}N$ and $^{18}F$ isotopes for radiotracer synthesis.

It is a further goal of the invention to provide an improved apparatus for simultaneous production of and selective extraction and recovery of usable quantities of $^{13}N$ and $^{18}F$ isotopes for radiotracer synthesis.

Other purposes and advantages of the present invention will be more fully apparent from the ensuing disclosure and appended claims.

SUMMARY OF THE INVENTION

These and other purposes and goals are achieved by the present invention which solves the disadvantages inherent in the prior art by providing a method for simultaneous production of usable quantities of $[^{13}N]NO_2^-/NO_3^-$ and $[^{18}F]F^-$ by a single irradiation of a target of low-enriched $[^{18}O]H_2O$.

The method of the present invention also allows the selective extraction and recovery of usable quantities of $[^{13}N]NO_2^-/NO_3^-$ and $[^{18}F]F^-$ from proton irradiation of low-enriched $[^{18}O]H_2O$ for radiotracer synthesis for PET. The present invention is amenable to automation and enables the avoidance of unnecessary radiation exposure to personnel, the reduction of excessive cyclotron usage, and the shortening of radiotracer delivery times.

The method uses an anion exchange resin, preferably a Bio-Rad AG 1-X8, carbonate form, 7 mm×2 mm i.d. column packed with 200–400 mesh, for simultaneous extraction of $[^{18}F]F^-$ and $[^{13}N]NO_3^-/NO_2^-$ anions from the target water after irradiation. Selective and near quantitative recovery of these radionuclides is achieved by rinsing the resin in series with 1.5 mL of a carbonate solution, preferably 0.01M $K_2CO_3$, to recover the bound $^{18}F$-activity and with 1.5 mL of an acid solution, preferably 1N HCl, to recover the bound $^{13}N$-activity. Rapid and quantitative conversion of the released $^{13}N$-activity can be accomplished over a reducing agent, preferably, Devarda's alloy, provided the acid solution is first made basic.

The invention also provides an apparatus for simultaneous production of $[^{13}N]NO_2^-$ and $[^{18}F]F^-$ anions by proton irradiation of a low-enriched $[^{18}O]H_2O$ target, the selective and near quantitative recovery of these radionuclides from the target water by sequential elution of the nuclides from an anion exchange resin, the conversions of $[^{13}N]NO_2^-/NO_3^-$ to $[^{13}N]NH_3$ by chemical reduction, and the conveyance of the radionuclides to a laboratory for radiotracer synthesis, preferably for PET scanning.

This method is amenable to automated processing of the radionuclides in the cyclotron vault. The key benefit seen by this is that it should be possible to effect simultaneous transfer of both $[^{18}F]F^-$ to the hot lab and $[^{13}N]NH_3$ gas directly to the PET facility thus streamlining radiotracer delivery times, and minimizing personnel exposure to radiation.

For a better understanding of the present invention, reference is made to the following description and accompanying figures, the scope of which is pointed out in the claims.

DETAILED DESCRIPTION OF THE INVENTION

Figure 1:
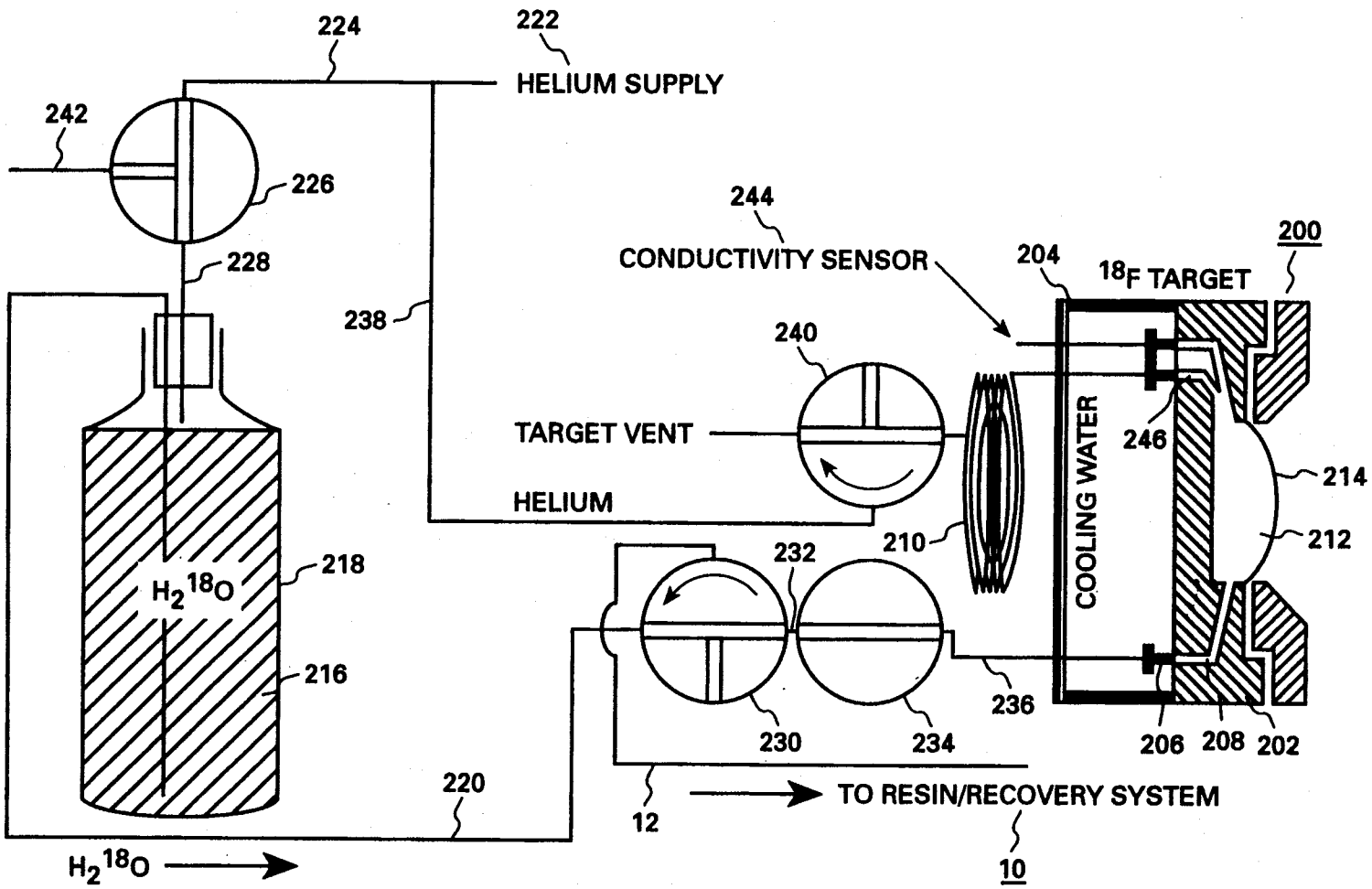
FIG. 1 is a schematic illustration of a target apparatus for carrying out proton irradiation of low-enriched $[^{18}O]H_2O$ in accordance with the method of the present invention.

Proton beams may be generated by various types of accelerators. The proton beam energies useful for the process of the invention may range from about 5 MeV to about 40 MeV, preferably from about 10 MeV to about 30 MeV. The proton beam current may range from about 5 μA to about 30 μA, preferably from about 8 μA to about 15 μA.

In the preferred embodiment of the present invention, proton irradiation may be performed using a 17.4 MeV proton beam generated by a proton accelerator (Japan Steel Works, Inc., Muroram-Shi, Hokkado, Japan; 17.4 MeV proton, 10 MeV deuteron cyclotron). The beam passes through the target cell window (0.001 inch thick titanium foil) relatively unimpeded and enters the target water with a beam energy of about 17.0 MeV and a beam current of about 12 μA. Those persons having experience in the art will recognize that other proton source parameters may be chosen depending upon the desired application and the types and quantities at desired isotopes. The proton bombardment will generally last until sufficient isotopes are produced, commonly from about 10 minutes to about 30 minutes, also depending on the application involved and the quantities of isotopes required. Most preferably, the proton bombardment will last about 20 minutes at the preferred beam parameters described.

Among other considerations, the high cost of $[^{18}O]H_2O$ (currently $140/gram at greater than 97% enrichment level: Isotec, Inc., Miamisburg, Ohio), its heat transfer characteristics and the quantities of isotopes necessary for radiotracer synthesis together dictate that the target cell have a capacity of from about 2 mL to about 5 mL, most preferably about 2.5 mL. Generally, high temperatures are induced in the target water during bombardment due to the energy deposited by the beam. Measures to reduce cavitation, due to boiling, and evaporation may be employed, such as the use of a very high overpressure of a gas, e.g., helium. Preferably, a water recirculating cooling method may be employed to remove heat generated by the beam impact on the target. This cooling is facilitated by the excellent heat transfer capacity of a ½ inch thick silver target typically used to stop the proton beam after it travels through the water.

The isotopes of interest, namely $^{13}N$ and $^{18}F$, are preferably produced by proton irradiation of low-enriched $[^{18}O]H_2O$. The $^{13}N$ isotope is preferably produced from a target containing non-enriched natural water by the $^{16}O(p,\alpha)^{13}N$ nuclear reaction. This reaction can take place in low-enriched $[^{18}O]H_2O$, as is preferred in the present invention, because of the preponderance of $[^{16}O]H_2O$ in the target. The $^{18}F$ isotope is preferably produced via the $^{18}O(p,n)^{18}F$ nuclear reaction and the production of usable quantities requires substantial enrichment of the water target with $[^{18}O]H_2O$ most preferably between about 20% and about 30% by weight. The relative proportion of $[^{16}O]H_2O$ to $[^{18}O]H_2O$ will be determined based on the relative quantities of $^{13}N$ and $^{18}F$ isotopes desired.

Since the two isotopes are produced by two different proton induced nuclear reactions involving different oxygen isotopes, the proportion of $^{13}N$ and $^{18}F$ produced in the target water will depend upon the relative proportion of $[^{16}O]H_2O$ and $[^{18}O]H_2O$ in the target and the incident proton beam energy. For the present invention, the quantities of each isotope product must be sufficient to be usable for radiotracer synthesis. The relative quantities of each isotope may vary depending upon the desired application and the individual facility's proton beam characteristics, but one advantage of the process of the invention is that neither $^{13}N$ nor $^{18}F$ is produced in merely trace quantities.

It is preferred, then, that the enrichment of the $[^{18}O]H_2O$ be in the range of from about 10% to about 60%, more preferably in the range of from about 15% to about 40%. Most preferably, the $[^{18}O]H_2O$ enrichment is in the range of from about 20% to about 30%. $[^{18}O]H_2O$ is available in enrichment levels ranging from 20% to 99% from Isotec, Inc., Miamisburg, Ohio. It has been found that lower enrichment levels of $[^{18}O]H_2O$, e.g., below 60%, permits production usable quantities of $^{18}F$ while simultaneously producing usable quantities of $^{13}N$. See Example 2 below. In particular, it has been found that the quantities of $^{13}N$ and $^{18}F$ produced with $[^{18}O]H_2O$ enrichment in the most preferred range are well-suited for radiotracer synthesis for combined $[^{13}N]NH_3$ and $[^{18}F]FDG$ use for PET studies of myocardial function.

When $^{13}N$ atoms are produced during the irradiation process, a large fraction recoil and ionize. The atoms then pick up hydrogen from the water to form $[^{13}N]NH_4^+$. The water itself then oxidizes the $[^{13}N]NH_4^+$ to form either of two nitrogen oxides ($NO_x^-$), i.e., nitrite ($[^{13}N]NO_2^-$) and nitrate ($[^{13}N]NO_3^-$). $[^{18}F]F^-$, on the other hand, generally does not form more complex ions when created in water. Once the $^{13}N$ and $^{18}F$ isotopic products have been collected on the anion exchange resin, the target water may be recovered for future re-use. This is especially preferred because of the high cost of the $[^{18}O]H_2O$ used for enrichment.

The present invention provides a method for removing the isotopes from the irradiated target water and further separating the isotopes. The isotope ions $[^{18}F]F^-$ and $[^{13}N]NO_x^-$ are removed from the irradiated target water by passing the target water over an anion exchange resin. The ions selectively bind to the resin and the target water may be recovered for re-use. The isotopes are then separated from one another on the basis of the relative selectivities of each ion for the resin through the use of a sequential elution process.

While not wishing to be bound by theory, it is generally accepted that anion exchange chromatography separates molecules on the basis of the charge carried by the anions being separated. Competing anions displace one another on the exchange resin on the basis of their relative selectivity for the resin or because a concentration differential in the eluant forces the equilibrium of the system in favor of their adsorption. Therefore, the separation of a mixture of anions can be effected by altering ionic strengths as well as pH.

The anion exchange resin useful for the method of the present invention may be selected from the group of anion exchange resins having substantial affinity for $F^-$ and $NO_2^-/NO_3^-$ anions, to allow differential elution. Generally, such anion exchange resins are classified as strong anion exchange resins.

Preferred anion exchange resins are resins having quaternary ammonium functional groups characterizable by the formula:

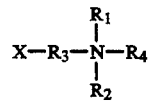

wherein X is a polymeric support resin and $R_1$, $R_2$, $R_3$, and $R_4$ are independently selected from the group consisting of hydrogen, and alkyl groups having 1 to 4 carbons. Especially preferred anion exchange resins are those resins having functional groups characterizable by the formula $$X—CH_2—N—(CH_3)_3,$$

wherein X is a polymeric resin support. Such an especially preferred resin is the AG 1 resin available in various forms from Bio-Rad Laboratories in Richmond, Calif. The AG 1 resin employs a copolymer of styrene and divinylbenzene as the support, with quaternary ammonium as the functional group. The degree of cross-linking in the polymeric support may be varied. Preferably, the AG 1 resins useful for the method of the invention may have between about 2% and about 10% cross-linking, most preferably about 8% cross-linking.

It is preferred that the anion exchange resin be in the form of particles useful in column chromatographic applications, but membrane format resins have also been found to be useful. Resin particles of a variety of sizes are useful, preferably of a size within the range of 106 μm diameter or less (140 mesh or higher). Smaller resin particles are preferred due to the small size at the column used in the preferred embodiment. It is most preferred that the ion exchange resin have a particle size in the range of 200–400 mesh, or from about 38 μm to about 75 μm in diameter, such as the AG 1-X8 resin available from Bio-Rad.

The preferred anion exchange resins useful in the invention exhibit differential selectivities from various anions. The relative selectivity for the ions generated by the method of the invention is generally characterizable by the sequence: $F^- < NO_2^- < NO_3^-$. The method of the invention takes advantage of this relative selectivity profile by eluting the $[^{18}F]F^-$ first, because of its lower affinity for the resin, and the $[^{13}N]NO_2^-/NO_3^-$ later, because of their higher affinities.

The anion exchange resin must generally have an anion electrostatically adsorbed to the resin prior to its use for separating other anions. To be effective, the anion electrostatically bound to the resin must have a relatively low affinity for the resin. More specifically, the original anion must have affinity for the resin similar to or lower than that of the anion sought to be extracted. Otherwise, the original anion will not be readily displaced, and the analyte anion will pass by the resin without binding.

The $F^-$ anion exhibits very weak affinity for the preferred resins of the invention. As a result, the original anion bound to the resin must have a comparable or even lower affinity. The preferred original anions are $OH^-$ and $CO_3^{2-}$. The most preferred form of the resin is the carbonate form, where the original electrostatically adsorbed anion is $CO_3^{2-}$.

The anionic radionuclides of the present invention have relatively different selectivities for the useful anion exchange resins described herein. $F^-$ anions generally have a much smaller selectivity than do $NO_2^-$ or $NO_3^-$ anions, i.e., on the order of 10-fold lower. Furthermore, the $NO_2^-$ anion has an approximately threefold lower selectivity than does the $NO_3^-$ anion. Therefore, useful counterions for $F^-$ extraction may be selected from the group having selectivities between the selectivity of $F^-$ and the selectivity of $NO_2^-$. A counterion selected from the group having selectivities between the selectivities of $NO_2^-$ and $NO_3^-$ would cause the contamination of the $F^-$ fraction with $NO_2^-$, and, accordingly, anions in this range are less preferred.

For the extraction of $F^-$, therefore, preferred counterions include propionate, acetate, formate, $HPO_4^-$, $IO_3^-$, $HCO_3^-$, and $CO_3^{2-}$. The most preferred eluant counterion is a carbonate ($CO_3^{2-}$) solution. The carbonate anion in the eluant may preferably be derived from a potassium ($K_2CO_3$) or cesium ($Cs_2CO_3$) salt. However, those skilled in the art will perceive that other cations may be employed as long as they do not interfere with the purity of recovery of the anionic radionuclides, and interfere with subsequent syntheses involving these anionic radionuclides. For example, the ammonium cation ($NH_4^+$) is undesirable, as are other nitrogen-containing cations.

The most preferred eluant for $[^{18}F]F^-$ elution is an aqueous solution of $K_2CO_3$, having a concentration in the range of from about 0.001M to about 0.05M, preferably from about 0.005M to about. 0.02M, most preferably about 0.01M. The carbonate eluant is preferably slightly basic and must not be strongly basic since $CO_3^{2-}$ will be degraded by strong base. The $CO_3^{2-}$ eluant has a pH of from about 7.5 to about 9.0, preferably from about 7.7 to about 8.5. Most preferably, the $CO_3^{2-}$ eluant has a pH of about 8.0. Those skilled in the art will recognize that a carbonate concentration of 0.01M is further preferable since the synthesis of $[^{18}F]$FDG employs reactants containing carbonate anion at or near this concentration. In the most preferred embodiment, approximately 1.5 mL of aqueous 0.01M $K_2CO_3$ is required to elute the $[^{18}F]F^-$ from the resin. Using eluant having these characteristics will generally permit the recovery of about 99% of the bound $[^{18}F]F^-$ activity at about 99% radionuclidic purity.

For the extraction of $NO_x^-$, a counterion having a selectivity near to or greater than that of $NO_2^-$ is preferable. Such counterions include $Cl^-$, $BrO_3^-$, $HSO_3^-$, $CN^-$, $Br^-$, $ClO_3^-$, $HSO_4^-$, and citrate. The most preferred eluant counterion is $Cl^-$, present as a solution of hydrochloric acid (HCl). HCl is preferably employed at a concentration of about 1 acid equivalent per liter, i.e., 1N HCl. The cationic portion of the counterionic salt preferably contains no nitrogen, in order to avoid diluting the percentage of $^{13}N$ in the eluate. Similar considerations apply to the selection of the counterion itself, i.e., $NO_2^-$ and $NO_3^-$ are less preferable as eluant counterions. In the most preferred embodiment approximately 1 mL of aqueous 1N HCl is required to elute the $NO_x^-$ from the resin. Using HCl eluant having these characteristics will generally allow the recovery of about 94% of the $[^{13}N]NO_x^-$ activity at about 99% radionuclidic purity.

The eluants generally are solutions, most preferably, aqueous solutions. The eluant solutions may comprise a mineral or organic acid or its salt, an electrolyte mixture of acid and salt, a base, or an electrolyte mixture of base and salt soluble in water. The concentration of the eluant is such that precipitation does not occur in either the anion exchange resin or external liquid phase. Generally, the concentration is from about 0.001 moles/liter to about 10 moles/liter (M). Also, the pH of the eluant is selected such that precipitation does not occur.

The separation column useful for the method of the invention may be of variable size. The diameter may range from about 1 mm to about 3 mm, preferably from about 2.5 mm to about about 3.5 mm. The length of the column may range from about 3 mm to about 10 mm, preferably from about 5 mm to about 8 mm. The separation column of the most preferred embodiment is approximately 2 mm in diameter and approximately 7 mm in length, therefore having a volume of approximately 0.022 mL. The volume of resin used for the separation of the isotope ions from the target water is therefore approximately 0.022 mL. Other dimensions of column and volumes of resin may be employed.

The temperature during the elution process may vary widely, i.e., from about 0° C. to about 100° C. or the boiling point of the eluant. The thermal stability of the resin must be considered when selecting a temperature or range of temperatures for elution. It is preferred that the temperature be in the range of from about 20° C. to about 50° C. most preferably about ambient temperature Once the $[^{13}N]NO_x^-$ has been eluted from the anion exchange resin, the eluate is acidic. The process of the invention used for converting $NO_x^-$ to $NH_3$, a form of $^{13}N$ useful for numerous applications, including clinical PET imaging, requires a reduction the $NO_x^-$ in alkaline solution. For this purpose, the $NO_x^-$ eluate is basified by being transferred to a basifying reservoir holding an alkaline solution capable of providing sufficient excess $OH^-$ ions to raise the pH of the eluate to the range of about pH 9–10 without undesirably increasing the volume of the eluate. This process usually requires the use of a strong base at relatively high concentration. The preferred base is an NaOH solution. In the most preferred embodiment the base will be 2N NaOH, and approximately 1.5 mL will be held in the basifier for addition to the 1.5 mL bolus of eluate received from the elution of the $NO_x^-$. More generally, it is preferred that the base solution contain approximately double the available acid equivalents of $OH^-$ as compared to the acid equivalents present in the $NO_x^-$ eluate. Furthermore, it is preferred that the base solution have a volume approximately equal to that of the $NO_x^-$ eluate. It will be noted by those skilled in the art that nitrogen-containing bases, such as $NH_4OH$ are less preferred because of their capacity to contaminate the $[^{13}N]NH_3$ product with natural nitrogen $[^{14}N]$.

After the pH of the $NO_x^-$ eluate has been adjusted to pH 9–10, the $NO_x^-$ in the eluate is preferably reduced by being transferred to a reaction vessel containing a strong reducing agent, preferably Devarda's alloy. Devarda's alloy is a commonly used strong reducing agent, that operates at alkaline pH, and contains variable amounts of copper, aluminum, and zinc. The Devarda's alloy most preferably contains approximately 50% copper, 45% aluminum, and 5% zinc, and is available from Aldrich Chemical Co. (Milwaukee, Wis.) The Devarda's alloy reduces $NO_x^-$, producing $NH_3$ gas. The $[^{13}N]NH_3$ gas is then transferred to the PET facility for use.

While the target cell configuration useful for proton irradiation of low-enriched $[^{18}O]H_2O$ in accordance with the present invention may be varied, the preferred embodiment is illustrated as 200 in FIG. 1. The target cell is shown in longitudinal section, i.e., a section in the vertical plane parallel to the path of a proton beam entering the cell. The preferred target cell is cylindrical, and therefore substantially circular in cross section, i.e., a section normal to the path of a beam entering the cell. The target cell is 2.5 cm in diameter with a thickness of 0.6 cm. Further details on the construction of the target cell may be found in "Impurities in the $[^{18}O]$ Water Target and Their Effect on the Yield of an Aromatic Displacement Reaction with $[^{18}F]$ Fluoride", D. J. Schlyer, M. L. Firouzbakht and A. P. Wolf, *Int. J. Appl. Radiat. Inst.* Part A (in press).

The main target chamber 202 is fabricated from silver. The water cooling block 204, attached to the rear of the target chamber 202, is fabricated from aluminum. Standard HPLC couplings 206 are electron beam welded onto the back of the silver target chamber 202. This allows direct coupling of conduits, e.g., 236, 210, into the target cell ports, e.g., 208, 246. A stainless steel coiled loop conduit 210 (2 mL volume) serves as an expansion volume for the low-enriched $[^{18}O]H_2O$ during loading. This is necessary because the target volume 212 is somewhat smaller when the front window 214 (0.001 inch thick titanium foil) is flat. Upon pressurization for irradiation, the water is displaced from the coil 210 into the cell 202 as the front window 214 deforms outwardly, as is shown. The target cell volume 212 when pressurized is approximately 2.5 mL.

Low-enriched $[^{18}O]H_2O$ target water 216 (labeled $H_2{}^{18}O$) is contained in reservoir 218 and may be pushed through conduit 220 past valve 230 and valve 234 into target volume 212. Helium drive pressure is provided by helium supply 222 through conduit 224, and via valve 226 and conduit 228, to the target water reservoir 218. After irradiation, the target water is driven by helium pressure from target cell 202 via conduit 238, past valve 240, and through coil conduit 210. Target water passes from target volume 212, returning through conduit 236 and via valve 234 to valve 230. Valve 230 directs the irradiated target water through conduit 12 to the resin/recovery system, illustrated in greater detail as 10 in FIG. 2. Conductivity sensor 244 is present in target volume 212 providing feedback regarding whether the target cell 202 is filled and ready for irradiation. The entire loading and unloading process is preferably electrically remotely controlled, most preferably automated. This system has been used in carrying out the experiments described in Examples 1 and 2.

Figure 2:
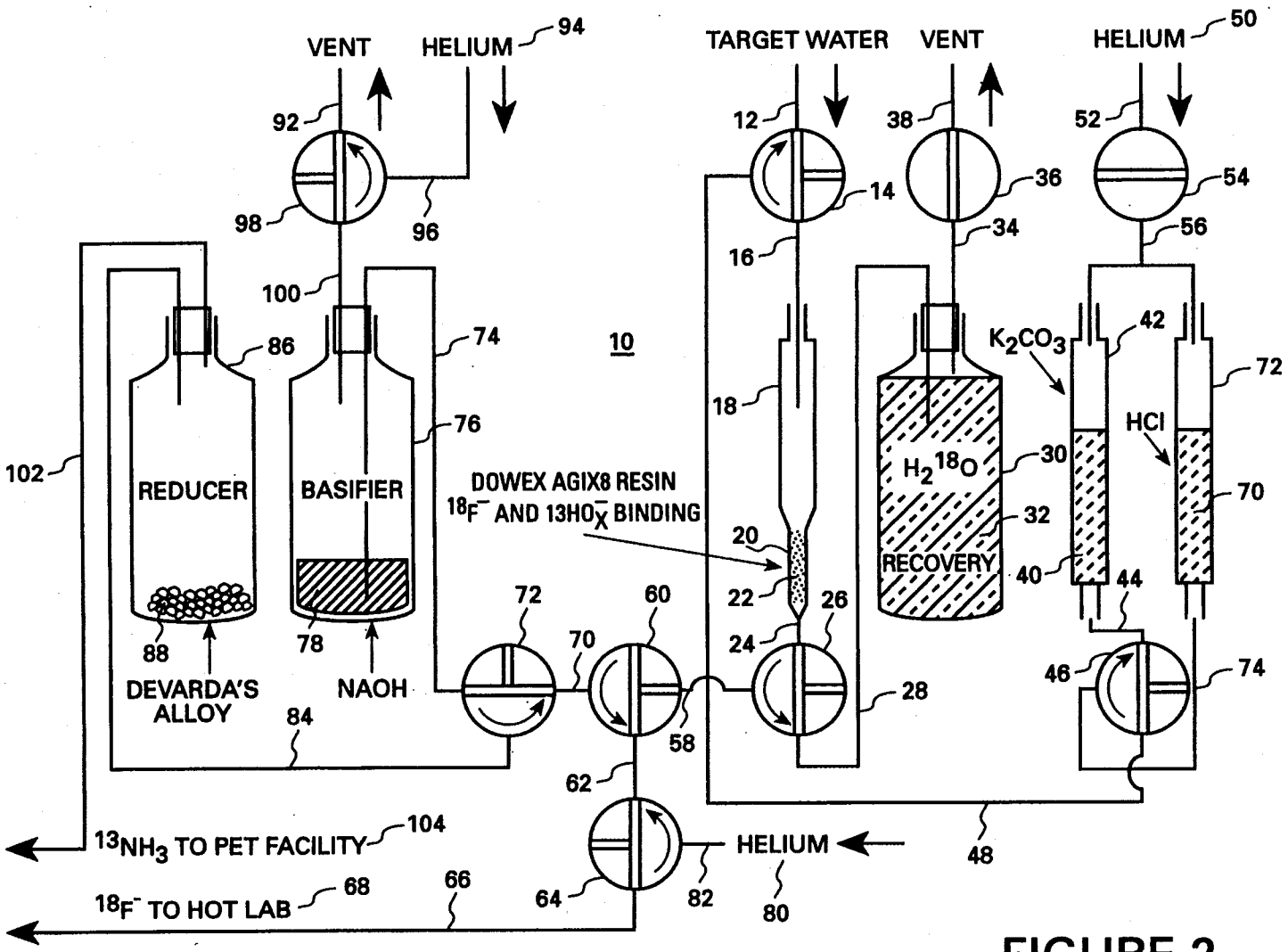
FIG. 2 is a schematic illustration of an apparatus for carrying out isotope separation steps in accordance with the method of the present invention.

Referring now to FIG. 2, an automated system for the quantitative recovery and separation of $[^{18}F]F^-$ and $[^{13}N]NO_2^-/NO_3^-$ from irradiated low-enriched $[^{18}O]H_2O$ is generally indicated as 10. A manual system similar to that represented in FIG. 2 has been used to carry out the experiments described in Examples 1 and 2.

The system 10 includes a conduit 12 for transferring irradiated target water by helium drive pressure, through valve 14 and conduit 16, to a reservoir 18. From reservoir 18, the irradiated target water is passed through column 20, containing anion exchange resin 22, where the $[^{18}F]F^-$ and $[^{13}N]NO_2^-/NO_3^-$ bind to the resin 22. The target water may then be recovered by passing through conduit 24 to valve 26 and conduit 28, to recovery reservoir 30 containing recovered target water 32. Pressure may be vented through pressure relief conduit 34, controlled by valve 36.

$K_2CO_3$ or other carbonate eluant 40 in reservoir 42 is then driven through conduit 44, past valve 46, and through conduit 48 until reaching valve 14. Helium drive pressure is generated from helium source 50, passed through conduit 52, controlled by valve 54, and through conduit 56. Valve 14 is operated to admit the carbonate eluant 40 through conduit 16 to reservoir 18. The carbonate eluant then passes to column 20 where the $[^{18}F]F^-$ is eluted from resin 22. Valve 26 is operated to pass the carbonate/$[^{18}F]F^-$ eluate from column 20 through conduit 24 to conduit 60. Valve 60 is operated to pass the $[^{18}F]F^-$ bolus through conduit 62. Valve 64 allows the bolus to pass through conduit 66 leading to hot lab 68.

HCl eluant 70 in reservoir 72 is then passed through conduit 74 and admitted to conduit 48 by valve 46. Helium drive pressure is generated from helium source 50 through conduit 52 controlled by valve 54, through conduit 56. Valve 14 is operated to admit the HCl eluant through conduit 16 to reservoir 18 and to column 20 where the $[^{13}N]NO_2^-/NO_3^-$ is eluted. Valve 26 admits the eluate through conduit 58, and valve 60 admits the eluate through conduit 70 to valve 72. Valve 72 is then operated to conduct the $[^{13}N]NO_2^-/NO_3^-$ eluate through conduit 74 to basifying reservoir 76 containing NaOH 78. The basified $^{13}N$ eluate is then returned to valve 72 by way of conduit 74, and conducted through conduit 84 to reducing reservoir 86 containing Devarda's alloy 88. Helium drive pressure is generated by helium source 94 to reverse flow from conduit 96 controlled by valve 98 through conduit 100. Once the $^{13}N$ eluate is reduced to $[^{13}N]NH_3$, it is passed through conduit 102 which would allow it to be transferred to the PET facility 104.

EXAMPLE 1

Table 1 illustrates the effect of the nature and strength of the eluant used for extraction of $[^{13}N]NO_2^-/NO_3^-$ and on the efficiency of recovery of the anions. The data were obtained using a manual system similar to that described above and illustrated in FIGS. 1 and 2. When the extraction reagent (eluant) is a carbonate anion ($CO_3^{2-}$), less than 1% of the $[^{13}N]NO_x^-$ was found to be eluted from the anion exchange resin. Hydrochloric acid was found to be the most effective extraction reagent for $[^{13}N]NO_3^-$ elution. The effectiveness of hydrochloric acid was also found to be a function of its concentration, with a higher concentration yielding greater recovery of $[^{13}N]NO_x^-$.

TABLE 1

Effect of the Nature and Strength of Extraction Reagent on Recovery Efficiency*

| Extraction Reagent | Reagent Strength | % $^{13}N$ Recovered From AG1-X8 Resin |
|---|---|---|
| $K_2CO_3$ | 0.01 M | <1 |
| $Cs_2CO_3$ | 0.005 M | <1 |
| NaOH | 1.0 N | 5 |
| NaOH | 10.0 N | 12 |
| Sodium Citrate | 0.1 M | 7 |
| Sodium Citrate | 0.5 M | 19 |
| Sodium Citrate | 0.045 M | 24 |
| Saline | 0.9% | 23 |
| $H_2SO_4$ | 1.0 N | 43 |
| HCl | 0.1 N | 16 |
| HCl | 0.5 N | 53 |
| HCl | 1.0 N | 82 |
| HCl | 2.5 N | 89 |

*All tests were carried out using 1 mL of the appropriate agent.

EXAMPLE 2

A series of experiments was performed, using a manual system similar to that described above and illustrated in FIGS. 1 and 2, to determine the relationship between the level of enrichment of the target water by $[^{18}O]H_2O$ and the production, distribution, and recovery of the radionuclides $^{18}F$ and $^{13}N$. Data obtained from these experiments are described in Table 2. The percentage enrichment of target water was examined in the range of from about 20% to about 50%. The radionuclidic distribution was found to vary in relation to the percentage enrichment of the target water. At 20% $[^{18}O]H_2O$, the radionuclidic distribution after irradiation was 23% $^{18}F$ to 77% $^{13}N$. At 50% $[^{18}O]H_2O$, however, the distribution had shifted to about 45% $^{18}F$ to 55% $^{13}N$. At all enrichment levels studied, the percent recovery of the radionuclides was consistently very high, as was the percent radionuclidic purity of the extracted fractions.

TABLE 2

Results From Studies on $^{18}F$ and $^{13}N$ Separation Using AG1-X8 Anion Exchange Columns

| % Enrichment of $H_2{}^{18}O$ | Recovered Target Activity as $^{18}F$ and $^{13}N$ (mCi at EOB)[c] | % Radionuclidic Distribution | | % Resin Recovery[a] | | % Radionuclidic Purity in Extracted Fractions | |
|---|---|---|---|---|---|---|---|
| | | $^{18}F$ | $^{13}N$ | $^{18}F$ | $^{13}N$ | $^{18}F$ | $^{13}N$ |
| 50 | 195 | 45 | 55 | >99 | 80 | 98.8 | 99.2 |
| 30 | 214 | 35 | 65 | >99 | 81 | 99.4 | 98.4 |
| 20 | 163 | 23 | 77 | >99 | 94[b] | 98.9 | 99.3 |

[a] $^{18}F$ was recovered from resin using 1.5 mL of 0.01 M $K_2CO_3$. $^{13}N$ was recovered from resin, after $^{18}F$ extraction, using 1 mL of 1N HCl.
[b] $^{13}N$ was recovered from resin in this case using 1.5 mL of 1N HCl.
[c] EOB is an abbreviation meaning "end of bombardment".

Thus while we have described what are presently the preferred embodiments of the present invention, other and further changes and modifications could be made without departing from the scope of the invention, and it is intended by the inventors to claim all such changes and modifications.

We claim:

1. An apparatus for simultaneous quantitative production and sequential recovery of $[^{13}N]NH_3$ and $[^{18}F]F^-$, comprising:

a proton source for providing a beam of protons, a target cell containing low-enriched $[^{18}O]H_2O$ target water for irradiation by said proton beam, anion separation means, serially connected to the target cell, through which said target water may be passed for removing $[^{13}N]NO_x^-$ and $[^{18}F]F^-$ from the target water, $[^{18}F]F^-$ eluting means, serially connected to an input of the anion separation means, by a valving means comprising a first eluant reservoir including a first eluant for selective elution of $[^{18}F]F^-$ from the anion separation means as a collectable $[^{18}F]F^-$ fraction, and $[^{13}N]NO_x^-$ eluting means, serially connected to an input of the anion separation means, by a valving means comprising a second eluant reservoir including a second eluant for selective elution of $[^{13}N]NO_x^-$ from the anion separation means as a collectable $[^{13}N]NO_x^-$ fraction means for separately and sequentially connecting each of said $[^{18}F]F^-$ eluting means and said $[^{13}N]NO_x^-$ eluting means to said input of said anion separation means, whereby exposure of low-enriched $[^{18}O]H_2O$ target water in the target cell to proton irradiation simultaneously produces $[^{13}N]NO_x^-$ and $[^{18}F]F^-$ in quantitatively recoverable amounts usable for radiotracer synthesis for PET imaging.

2. The apparatus of claim 1, further comprising a target water recovery reservoir, serially connected to an output of the anion separation means, such that target water can be recovered once $[^{13}N]NO_x^-$ and $[^{18}F]F^-$ have been removed.

3. The apparatus of claim 1, wherein the target cell is further adapted to receive proton irradiation from at least one proton beam having a beam energy of between about 10 MeV and about 30 MeV.

4. The apparatus of claim 1, wherein the anion separation means comprises an anion exchange column containing particulate anion exchange resin having quaternary ammonium functional groups having the formula:

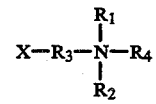

wherein X is a polymeric support resin and $R_1$, $R_2$, $R_3$, and $R_4$ are independently selected from the group consisting of hydrogen, and alkyl groups having 1 to 4 carbons.

5. The apparatus of claim 4, wherein the functional groups have the formula:

$$X—CH_2—N—(CH_3)_3,$$

wherein X is a polymeric support resin.

6. The apparatus of claim 1, wherein the $[^{18}F]F^-$ eluting means includes the first eluant as aqueous 0.01M $K_2CO_3$.

7. The apparatus of claim 1, wherein the $[^{13}N]NO_x^-$ eluting means includes the second eluant as aqueous 1N HCl.

8. The apparatus of claim 1, further comprising:

basifying means, serially connected to an output of the anion separation means for rendering the $[^{13}N]NO_x^-$ fraction alkaline to yield a basic $[^{13}N]NO_x^-$ fraction, and reducing means, serially connected to an output of the basifying means, for reducing the basic $[^{13}N]NO_x^-$ fraction to yield collectable $[^{13}N]NH_3$.

9. The apparatus of claim 8, wherein the basifying means includes a strong base.

10. The apparatus of claim 9, wherein the strong base includes aqueous 2N NaOH.

11. The apparatus of claim 8, wherein the reducing means includes DeVarda's alloy.

* * * * *